US008939135B2

(12) United States Patent
Maruyama et al.

(10) Patent No.: US 8,939,135 B2
(45) Date of Patent: Jan. 27, 2015

(54) INTERNAL COMBUSTION ENGINE SYSTEM, METHOD OF DETERMINING OCCURRENCE OF AIR-FUEL RATIO IMBALANCE THEREIN, AND VEHICLE

(75) Inventors: Kenya Maruyama, Nissin (JP); Takahiro Nishigaki, Nagoya (JP); Toshitake Sasaki, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 678 days.

(21) Appl. No.: 12/985,829

(22) Filed: Jan. 6, 2011

(65) Prior Publication Data

US 2011/0174282 A1 Jul. 21, 2011

(30) Foreign Application Priority Data

Jan. 18, 2010 (JP) ..... 2010-008348

(51) Int. Cl.
*F02D 41/00* (2006.01)
*F02D 41/14* (2006.01)

(52) U.S. Cl.
CPC ..... *F02D 41/0085* (2013.01); *F02D 41/1498* (2013.01); *F02D 41/1454* (2013.01)
USPC ..... 123/703; 701/103

(58) Field of Classification Search
CPC ..... F02D 41/00; F02D 41/22; F02D 43/00; F02D 41/0025; F02D 41/0045; F02D 41/1454; F02P 5/15
USPC ..... 123/479, 672, 673, 698, 700, 703, 704; 701/103–105; 73/114.69, 114.72, 73/114.73
See application file for complete search history.

(56) References Cited

U.S. PATENT DOCUMENTS 5,485,382 A * 1/1996 Seki et al. ..... 701/109
5,623,913 A * 4/1997 Kitajima et al. ..... 123/673
5,651,353 A * 7/1997 Allston ..... 123/673

(Continued)

FOREIGN PATENT DOCUMENTS

JP 11303662 A 11/1999
JP 2002317675 A 10/2002

(Continued)

OTHER PUBLICATIONS

Japanese Office Action issued Dec. 20, 2011 from JP 2010-008348 with partial English translation.

*Primary Examiner* — John Kwon
*Assistant Examiner* — Johnny H Hoang
(74) *Attorney, Agent, or Firm* — Gifford, Krass, Sprinkle, Anderson & Citkowski, P.C.

(57) ABSTRACT

When an engine is in a predetermined steady operating state, a gradient accumulation average value ΔAulsa corresponding to the amount of change in the air-fuel ratio AF, detected by an air-fuel ratio sensor, over the period of time from when an upper peak is reached, at which the direction of change in the air-fuel ratio AF is inverted to when a lower peak is reached, at which the subsequent inversion of the direction occurs, is calculated (S100 to S160) and, when the calculated gradient accumulation average value ΔAulsa is greater than a predetermined threshold value ΔAref1 that is determined in advance as an upper limit (absolute value) of the range, in which it may be determined that the air-fuel ratio is even between the cylinders of the engine (S165 to S175), it is determined that the engine is in an air-fuel ratio imbalance state, in which there is an imbalance in air-fuel ratio between the cylinders of the engine.

18 Claims, 10 Drawing Sheets

(56) References Cited

U.S. PATENT DOCUMENTS

| | | | | |
|---|---|---|---|---|
| 5,715,796 | A * | 2/1998 | Suzuki et al. | 123/492 |
| 5,842,339 | A * | 12/1998 | Bush et al. | 60/274 |
| 6,308,697 | B1 * | 10/2001 | Surnilla et al. | 123/672 |
| 6,904,355 | B2 * | 6/2005 | Yasui et al. | 701/108 |
| 7,103,467 | B2 * | 9/2006 | Takahashi et al. | 701/109 |
| 7,216,639 | B2 * | 5/2007 | Ozaki et al. | 123/674 |
| 7,603,994 | B2 * | 10/2009 | Ueda | 123/673 |
| 7,894,972 | B2 * | 2/2011 | Aliakbarzadeh et al. | 701/103 |
| 8,250,912 | B2 * | 8/2012 | Odendall | 73/114.73 |
| 8,509,984 | B2 * | 8/2013 | Kidokoro et al. | 701/29.1 |
| 2004/0003804 | A1 * | 1/2004 | Yasui | 123/673 |
| 2005/0022510 | A1 * | 2/2005 | Nakagawa et al. | 60/285 |
| 2007/0163547 | A1 | 7/2007 | Nakasaka | |
| 2007/0240695 | A1 * | 10/2007 | Mitsuda et al. | 123/673 |
| 2008/0083390 | A1 * | 4/2008 | Nishikiori | 123/179.4 |
| 2009/0037079 | A1 * | 2/2009 | Suzuki et al. | 701/103 |
| 2009/0171550 | A1 * | 7/2009 | Teraya | 701/102 |
| 2010/0300418 | A1 * | 12/2010 | Aoki | 123/703 |
| 2011/0271665 | A1 * | 11/2011 | Iwazaki et al. | 60/301 |
| 2012/0035831 | A1 * | 2/2012 | Kidokoro et al. | 701/104 |
| 2012/0232773 | A1 * | 9/2012 | Iwazaki et al. | 701/103 |
| 2012/0323466 | A1 * | 12/2012 | Iwazaki et al. | 701/104 |

FOREIGN PATENT DOCUMENTS

| | | | |
|---|---|---|---|
| JP | 2003138962 | A | 5/2003 |
| JP | 2005214073 | A | 8/2005 |
| JP | 2006220133 | A | 8/2006 |
| JP | 2007056832 | A | 3/2007 |
| JP | 2007113515 | A | 5/2007 |
| JP | 2008309065 | A | 12/2008 |
| JP | 2009197655 | A | 9/2009 |

* cited by examiner

INTERNAL COMBUSTION ENGINE SYSTEM, METHOD OF DETERMINING OCCURRENCE OF AIR-FUEL RATIO IMBALANCE THEREIN, AND VEHICLE

CROSS-REFERENCE TO RELATED APPLICATION

This application claims priority to Japanese Patent Application No. 2010-008348 filed on Jan. 18, 2010, which is incorporated herein by reference in its entirety including the specification, drawings and abstract.

BACKGROUND OF THE INVENTION

1. Field of the Invention

The invention relates to an internal combustion engine system, a method of determining the occurrence of an air-fuel ratio imbalance state therein, and a vehicle.

2. Description of the Related Art

This kind of internal combustion engine system has been proposed that includes a multi-cylinder internal combustion engine, in which each cylinder is provided with a fuel injection valve, and an air-fuel ratio sensor disposed downstream of a combining portion, at which flows of exhaust gas from the cylinders of the internal combustion engine are combined, and that determines whether there is variation in air-fuel ratio between the cylinders of the internal combustion engine (see Japanese Patent Application Publication No. 2008-309065 (JP-A-2008-309065), for example). This system calculates the amount of exhaust gas for each of the cylinders based on a rotation speed and a load factor of the internal combustion engine, performs calculation of the amount of fuel at the combining portion, at which the flows of exhaust gas are combined, by dividing the amount of exhaust gas at the combining portion obtained from the calculated amount of exhaust gas of each cylinder by a detection value sent from the air-fuel ratio sensor, and estimates the amount of fuel for each of the cylinders based on the calculated amount of fuel at the combining portion with the use of an observer. Then, the air-fuel ratio for each of the cylinders is calculated by dividing the calculated amount of exhaust gas of each cylinder by the estimated amount of fuel of each of the cylinders and it is determined whether the amount of variation in air-fuel ratio between the cylinders is excessively large, based on the calculated air-fuel ratio of each of the cylinders.

In the above system, in order to determine the variation in air-fuel ratio between the cylinders of the internal combustion engine, various calculations are required, such as calculation of the amount of exhaust gas for each of the cylinders, calculation of the amount of fuel at the exhaust gas flow-combining portion, and estimation of the amount of fuel for each of the cylinders. In addition, it is also required to design the observer for observing the state of the amount of fuel of each of the cylinders based on the amount of fuel determined at the exhaust gas flow-combining portion in advance. In particular, when the observer is designed with the use of a simple model, a highly accurate output cannot be obtained and therefore, there is a case where it is difficult to properly design the observer. Thus, it is desirable to facilitate the determination of the variation in air-fuel ratio between the cylinders.

SUMMARY OF THE INVENTION

The invention provides an internal combustion engine system, a method of determining the occurrence of an air-fuel ratio imbalance state therein, in which there is an imbalance in air-fuel ratio between the cylinders of the internal combustion engine, and a vehicle of the invention, with which it is possible to determine the occurrence of the air-fuel ratio imbalance state easier.

An internal combustion engine system of the invention has a multi-cylinder internal combustion engine, in which fuel injection is performed for each of cylinders, the internal combustion engine system including: an air-fuel ratio detection device that detects an air-fuel ratio and that is provided in an exhaust pipe, at which flows of exhaust gas from the cylinders of the internal combustion engine are combined; and an air-fuel ratio state determination section that, when the internal combustion engine is in a predetermined steady operating state and the amount of change per unit time in the detected air-fuel ratio is not within a predetermined range, determines that the internal combustion engine is in an air-fuel ratio imbalance state, in which there is an imbalance in air-fuel ratio between the cylinders of the internal combustion engine.

In the internal combustion engine system of the invention, when a multi-cylinder internal combustion engine, in which fuel injection is performed for each of cylinders, is in the predetermined steady operating state, and the amount of change per unit time in the air-fuel ratio detected by the air-fuel ratio detection device that detects an air-fuel ratio and that is provided in an exhaust pipe, at which flows of exhaust gas from the cylinders of the internal combustion engine are combined, is not within a predetermined range, it is determined that the internal combustion engine is in the air-fuel ratio imbalance state, in which there is an imbalance in air-fuel ratio between the cylinders of the internal combustion engine. In this way, whether the internal combustion engine is in the air-fuel ratio imbalance state is determined by comparing the amount of change per unit time in the air-fuel ratio detected by the air-fuel ratio detection device with the predetermined range, so that it is possible to determine the occurrence of the air-fuel ratio imbalance state easier.

A vehicle of the invention is installed with the internal combustion engine system of the invention that basically has a multi-cylinder internal combustion engine, in which fuel injection is performed for each of cylinders, the internal combustion engine system including: an air-fuel ratio detection device that detects an air-fuel ratio and that is provided in an exhaust pipe, at which flows of exhaust gas from the cylinders of the internal combustion engine are combined; and an air-fuel ratio state determination section that, when the internal combustion engine is in the predetermined steady operating state and the amount of change per unit time in the detected air-fuel ratio is not within a predetermined range, determines that the internal combustion engine is in the air-fuel ratio imbalance state, in which there is an imbalance in air-fuel ratio between the cylinders of the internal combustion engine.

The vehicle of the invention is installed with the internal combustion engine system of the invention and therefore, the effect similar to that brought about by the internal combustion engine system of the invention, such as the effect of making it possible to determine the occurrence of the air-fuel ratio imbalance state easier, is brought about.

An air-fuel ratio imbalance state determination method of the invention is a method of determining, in an internal combustion engine system including a multi-cylinder internal combustion engine, in which fuel injection is performed for each of cylinders, and an air-fuel ratio detection device that detects an air-fuel ratio and that is provided in an exhaust pipe, at which flows of exhaust gas from the cylinders of the internal combustion engine are combined, whether the internal combustion engine is in the air-fuel ratio imbalance state, in which there is an imbalance in air-fuel ratio between the cylinders of the internal combustion engine of the internal combustion engine system, the method including determining that the internal combustion engine is in the air-fuel ratio imbalance state when the internal combustion engine is in a predetermined steady operating state and the amount of change per unit time in the detected air-fuel ratio is not within a predetermined range.

In the air-fuel ratio imbalance state determination method of the invention, when a multi-cylinder internal combustion engine, in which fuel injection is performed for each of cylinders, is in the predetermined steady operating state, and the amount of change per unit time in the air-fuel ratio detected by an air-fuel ratio detection device that detects an air-fuel ratio and that is provided in an exhaust pipe, at which flows of exhaust gas from the cylinders of the internal combustion engine are combined, is not within a predetermined range, it is determined that the internal combustion engine is in the air-fuel ratio imbalance state, in which there is an imbalance in air-fuel ratio between the cylinders of the internal combustion engine. In this way, whether the internal combustion engine is in the air-fuel ratio imbalance state is determined by comparing the amount of change per unit time in the air-fuel ratio detected by the air-fuel ratio detection device with the predetermined range, so that it is possible to determine the occurrence of the air-fuel ratio imbalance state easier.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENT

A mode for carrying out the invention will be described below, referring to an embodiment of the invention.

Figure 1:
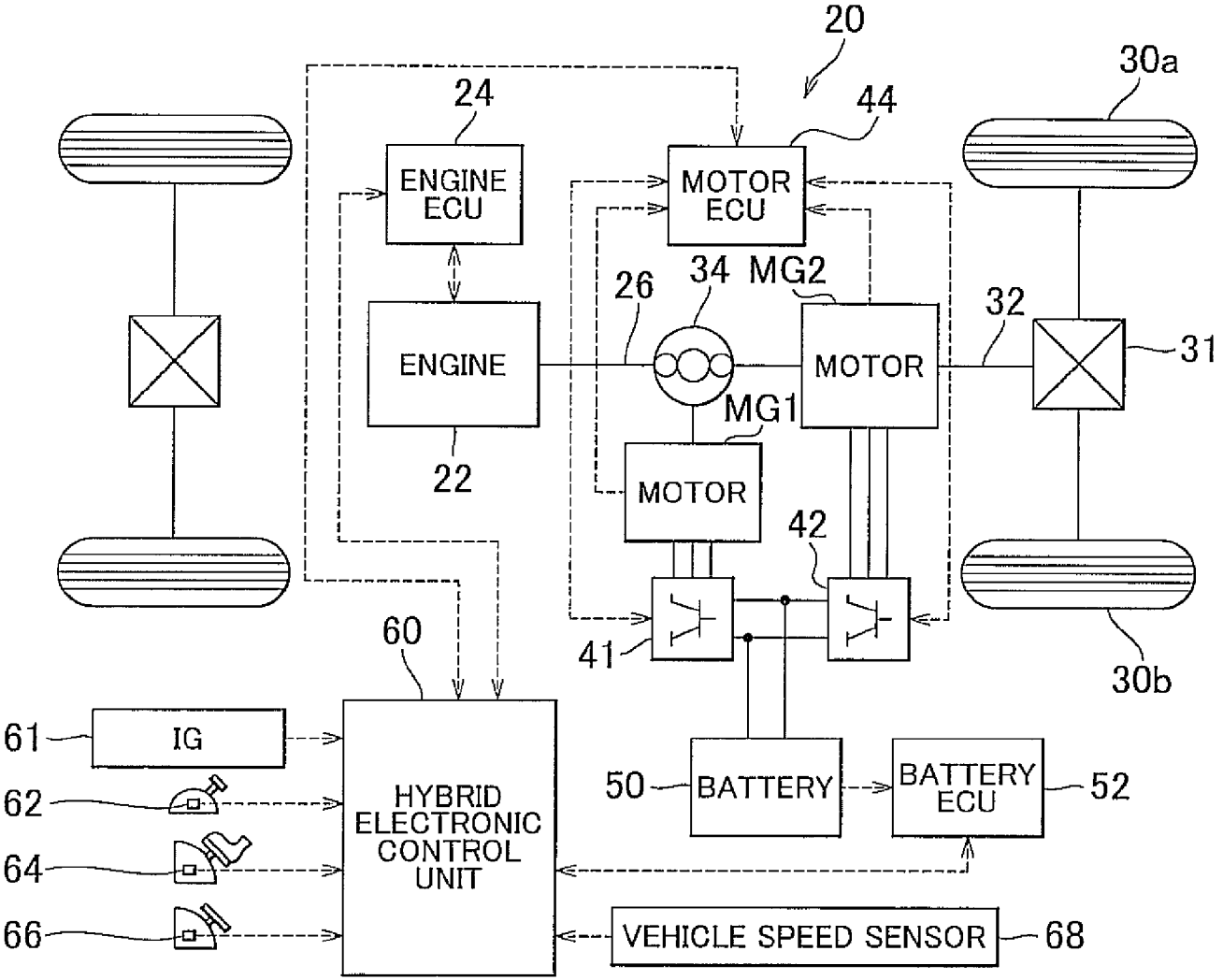
FIG. 1 is a configuration diagram showing a schematic configuration of a hybrid car 20 installed with an internal combustion engine system, which is an embodiment of the invention.

FIG. 1 is a configuration diagram showing a schematic configuration of a hybrid car 20 installed with an internal combustion engine system, which is an embodiment of the invention. As shown in FIG. 1, the hybrid car 20 of the embodiment includes: an engine 22, which is an internal combustion engine; an engine electronic control unit (hereinafter referred to as the engine ECU) 24 that controls driving of the engine 22; a planetary gear mechanism 34 that has a carrier connected to a crankshaft 26 of the engine 22, and a ring gear connected to a drive shaft 32 that is coupled to driving wheels 30*a* and 30*b* via a differential gear 31; a motor MG1, configured as a synchronous generator/motor, for example, that has a rotor connected to a sun gear of the planetary gear mechanism 34; a motor MG2, configured as a synchronous generator/motor, for example, that has a rotor connected to the drive shaft 32; an inverter 41 and an inverter 42 that drive the motors MG1 and MG2, respectively; a motor electronic control unit (hereinafter referred to as the motor ECU) 44 that supplies various signals to control switching of switching elements (not shown) of the inverters 41 and 42, thereby controlling driving of the motors MG1 and MG2; a battery 50 that exchanges electric power with the motors MG1 and MG2 via the power lines shared by the inverters 41 and 42; a battery electronic control unit (hereinafter referred to as the battery ECU) 52 that manages the battery 50; and a hybrid electronic control unit 60 that receives an ignition signal from an ignition switch 61, a signal indicating a shift position SP from a shift position sensor 62 for detecting a position of a shift lever, a signal indicating an accelerator pedal operation amount Acc from an accelerator pedal position sensor 64 for detecting the amount of depression of an accelerator pedal, a signal indicating a brake pedal position BP from a brake pedal position sensor 66 for detecting the amount of depression of a brake pedal, and a signal indicating a vehicle speed V from a vehicle speed sensor 68, and communicates with the engine ECU 24, the motor ECU 44, and the battery ECU 52 to control the entire vehicle. Main components of the internal combustion engine system of the embodiment are the engine 22, an air-fuel ratio sensor 135*a* to be described later that is provided in the exhaust system of the engine 22, and the engine ECU 24.

Figure 2:
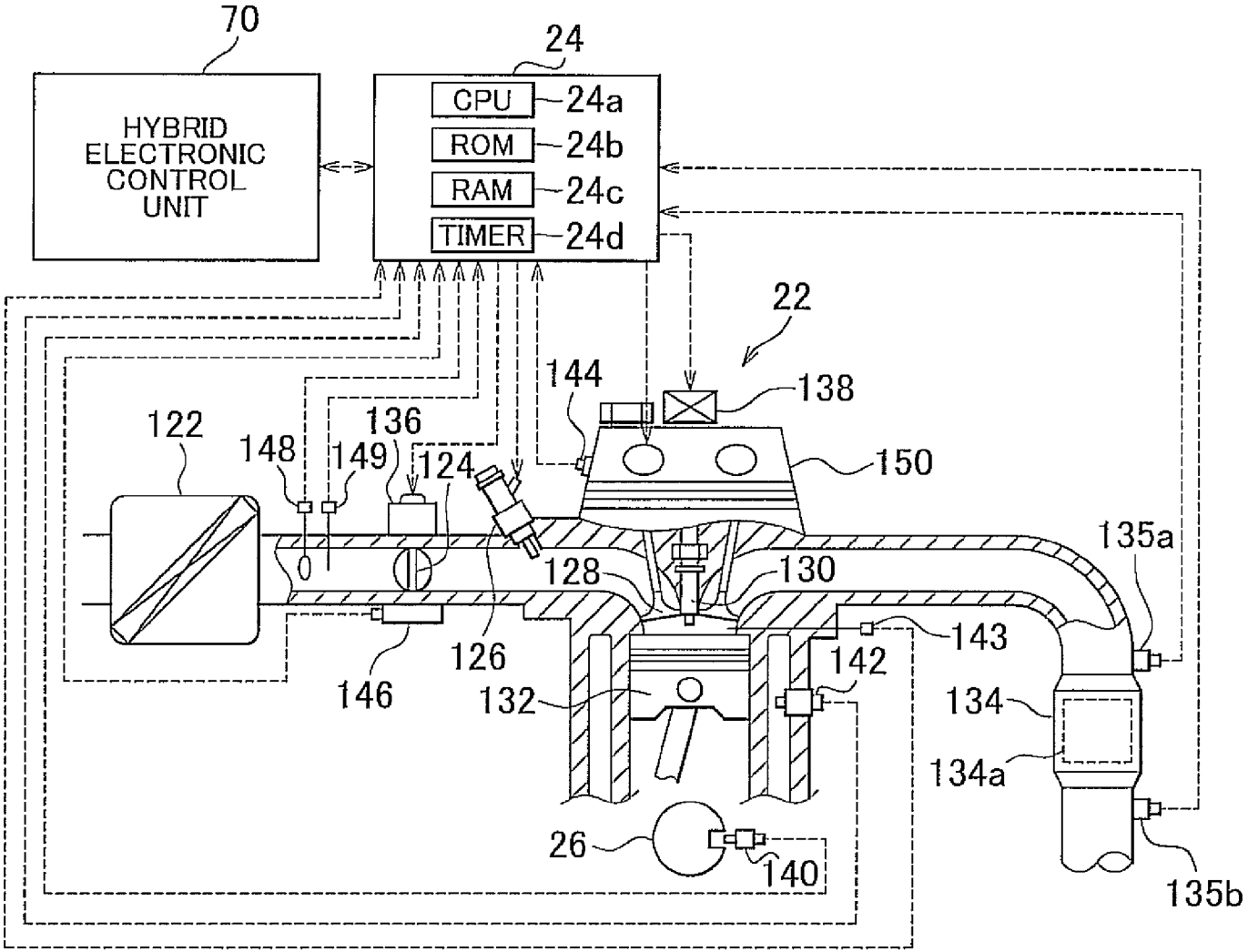
FIG. 2 is a configuration diagram showing a schematic configuration of an engine 22.
Figure 3:
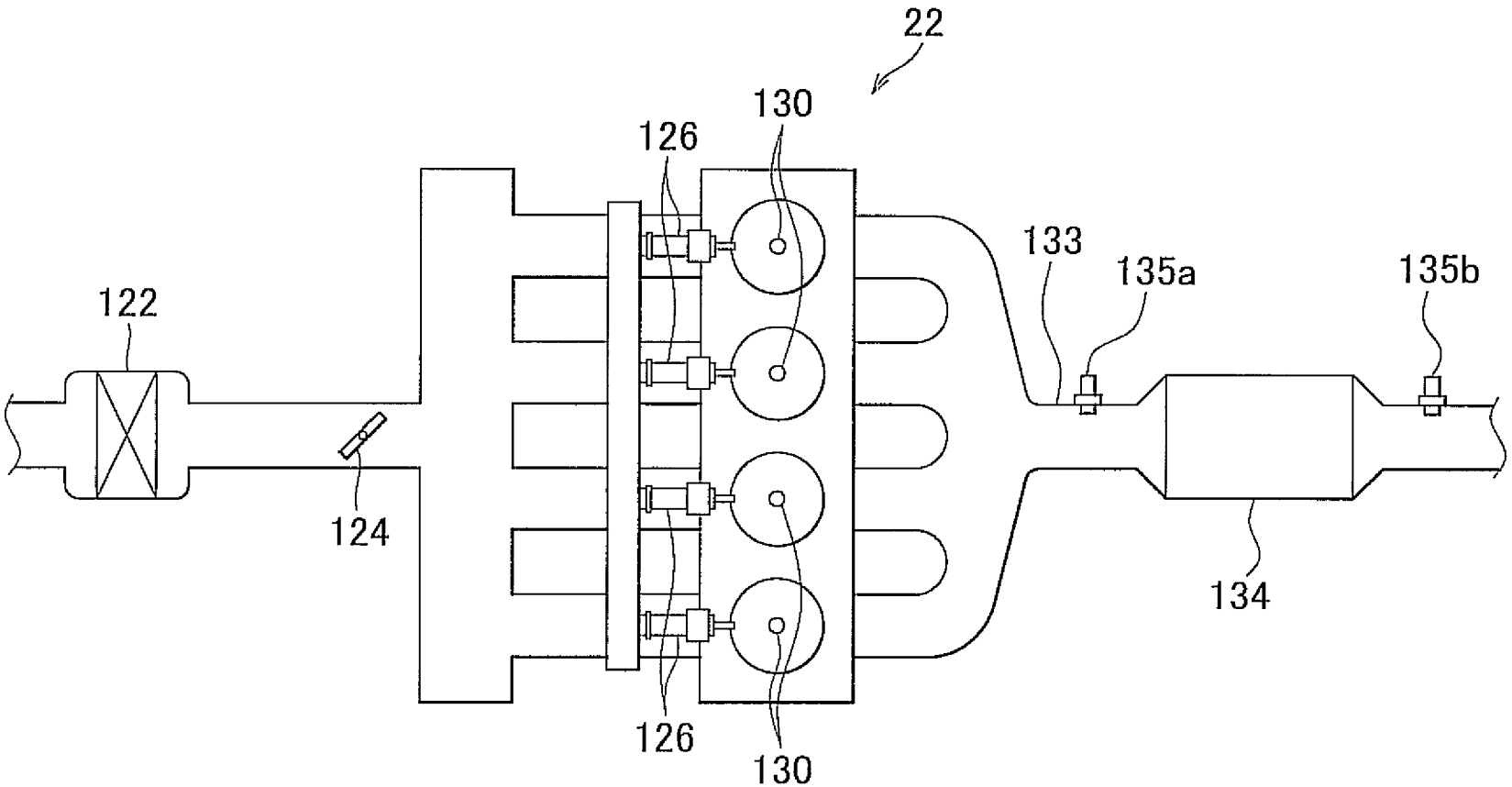
FIG. 3 is a configuration diagram schematically showing part of a configuration of the engine 22.

The engine 22 is configured as an internal combustion engine that outputs motive power with the use of a hydrocarbon fuel, such as gasoline or diesel fuel. As shown in FIG. 2, the engine 22 takes in air cleaned by an air cleaner 122 through a throttle valve 124, mixes the intake air with gasoline by injecting gasoline from fuel injection valves 126, sucks the mixture into combustion chambers through intake valves 128, causes the mixture to explode by the electric sparks produced by spark plugs 130, and converts the reciprocation of pistons 132 pushed down by the energy produced by the explosion into the rotation of the crankshaft 26. The exhaust gas of the engine 22 is discharged into the atmosphere through a purification device 134 that has a three-way catalyst 134*a* for removing the harmful components, such as carbon monoxide (CO), hydrocarbons (HC), and nitrogen oxides (NOx). As shown in FIG. 3, the engine 22 is configured as a four-cylinder internal combustion engine. Each cylinder is provided with the fuel injection valve 126, the intake valve 128 (omitted in FIG. 3), and the spark plug 130. One cycle of each cylinder includes four strokes, intake stroke, compression stroke, expansion stroke, and exhaust stroke. Fuel injection and ignition are performed with the phase difference of 180 degree in crank angle in the order of the first cylinder, the third cylinder, the fourth cylinder, and the second cylinder. In the description of the embodiment below, one cycle of the engine 22 means the rotation period, in which the crankshaft 26 rotates 720 degrees and the four strokes are completed in all the cylinders. An exhaust pipe 133 (upstream of the purification device 134), at which the flows of exhaust gas from the respective cylinders of the engine 22 are combined, is provided with the air-fuel ratio sensor 135*a* for detecting the air-fuel ratio that has a characteristic such that the output value varies substantially linearly. An oxygen sensor 135*b* that has a characteristic such that the output value sharply varies depending on whether the air-fuel ratio is richer or leaner than the stoichiometric air-fuel ratio, is installed downstream of the purification device 134.

The engine ECU 24 is a microprocessor having a central processing unit (CPU) 24*a* as the core and includes, in addition to the CPU 24, a read only memory (ROM) 24*b* that stores processing programs, a random access memory (RAM) 24*c* that temporarily stores data, a timer 24*d* that executes a counting process according to a command to count, and an input/output port and a communication port (not shown). The engine ECU 24 receives signals from various sensors for detecting the conditions of the engine 22, such as a signal indicating a crank angle CA from a crank position sensor 140 for detecting the crank angle of the crankshaft 26, a signal indicating a coolant temperature from a water temperature sensor 142 for detecting the temperature of the cooling water of the engine 22, signals indicating in-cylinder pressures from pressure sensors 143 installed in the combustion chambers, signals indicating cam positions from cam position sensors 144 for detecting the rotational positions of the cam shafts that open and close the intake valves 128 and the exhaust valves used for intake and exhaust into and from the combustion chambers, a signal indicating a throttle valve opening degree from a throttle valve position sensor 146 for detecting the position of the throttle valve 124, a signal indicating an intake air amount Qa from an air flow meter 148 installed in the intake pipe, a signal indicating an intake air temperature from a temperature sensor 149 installed in the intake pipe, a signal indicating the air-fuel ratio AF from the air-fuel ratio sensor 135*a*, and an oxygen signal, O2, from the oxygen sensor 135*b*, via the input port. The engine ECU 24 outputs various control signals for driving the engine 22, such as driving signals supplied to the fuel injection valves 126, a driving signal supplied to a throttle motor 136 for adjusting the position of the throttle valve 124, a control signal supplied to an ignition coil 138 united with an igniter, and a control signal supplied to a variable valve timing mechanism 150 that changes the opening/closing timing of the intake valve 128, via the output port. The engine ECU 24 also calculates the rotation speed of the crankshaft 26, that is, the rotation speed Ne of the engine 22, based on the crank angle CA received from the crank position sensor 140.

Next, operation of the internal combustion engine system installed in the hybrid car 20 of the embodiment configured as described above, in particular, operation performed to determine whether the engine 22 is in a state where there is an imbalance in air-fuel ratio between the cylinders of the engine 22 (hereinafter referred to as the air-fuel ratio imbalance state). FIGS. 4 to 7 are flow charts showing an example of first to fourth determination process routines, respectively, that are executed by the engine ECU 24 to determine the occurrence of the air-fuel ratio imbalance state. These routines are executed in parallel when the engine 22 is in a predetermined steady operating state. In the embodiment, the predetermined steady operating state is a state where operation for warming up the catalyst of the purification device 134 is being performed and operation for warming up the engine 22 is being performed immediately after the ignition switch is turned on (for example, when the engine 22 and the motor MG1 are controlled so that the engine 22 is operating at a predetermined rotation speed Nset for warming up, which is a rotation speed slightly higher than the idling speed, and a predetermined, small torque Tset for warming up is output from the engine 22). The first to fourth determination processes will be described below in order.

Figure 4:
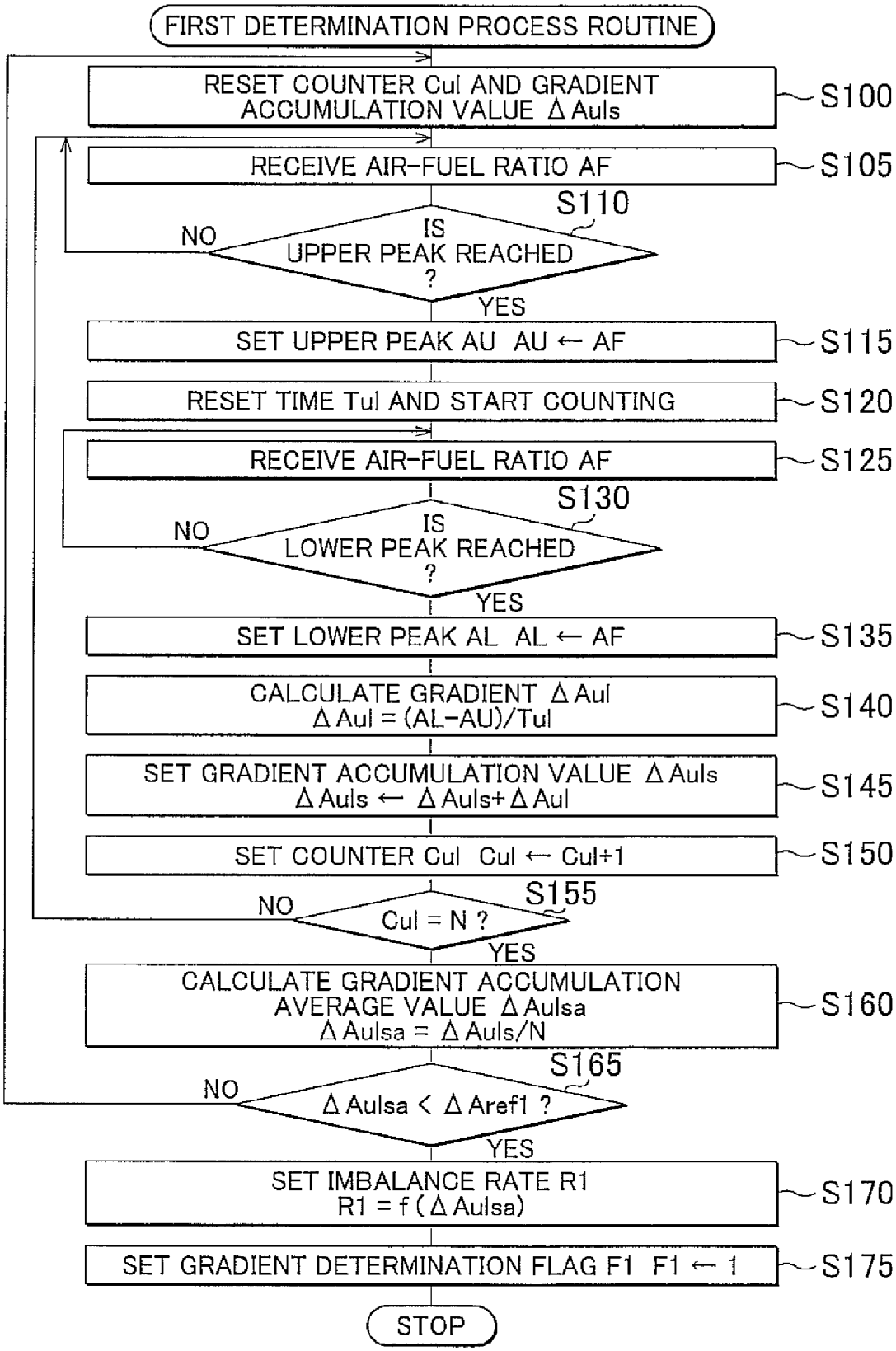
FIG. 4 is a flow chart showing an example of a first determination process routine to be executed by an engine ECU 24.
Figure 5:
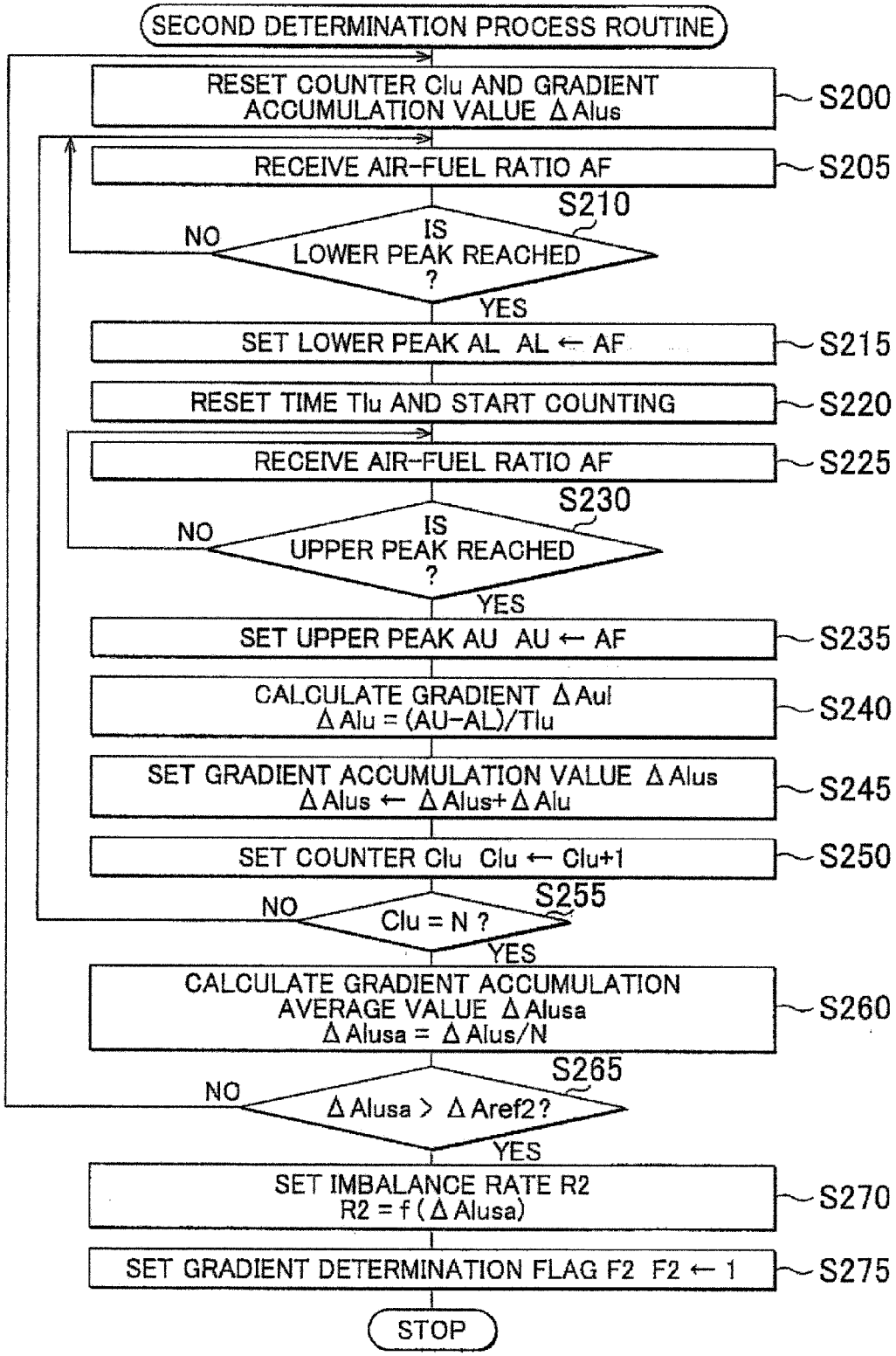
FIG. 5 is a flow chart showing an example of a second determination process routine to be executed by the engine ECU 24.

When the first determination process routine shown in FIG. 4 is executed, the CPU 24*a* of the engine ECU 24 first resets a counter Cul used in this routine and a gradient accumulation value ΔAuls to be described later to zero (step S100), receives the air-fuel ratio AF from the air-fuel ratio sensor 135*a* (step S105), and executes the process for determining whether the air-fuel ratio AF sent from the air-fuel ratio sensor 135*a* has reached a peak (hereinafter referred to as the upper peak), convex upward (on the lean side on which the value of the air-fuel ratio AF is large), of the periodic variation of the air-fuel ratio AF (step S110). In this embodiment, whether the air-fuel ratio AF has reached the upper peak is determined based on whether the difference obtained by subtracting the air-fuel ratio AF received in the preceding execution of step S105 from the air-fuel ratio AF received in the current execution of step S105, which is repeatedly executed in this routine.

When the air-fuel ratio AF sent from the air-fuel ratio sensor 135*a* has not reached the upper peak yet, the processes of steps S105 and S110 are repeatedly executed. When the air-fuel ratio AF reaches the upper peak, the air-fuel ratio AF received in the current execution is set as an upper peak air-fuel ratio AU (step S115), a time Tul that is used to count in this routine is reset to zero and counting of the time Tul is started by the timer 24*d* (step S120), the air-fuel ratio AF sent from the air-fuel ratio sensor 135*a* is received (step S125), and it is determined whether the air-fuel ratio AF sent from the air-fuel ratio sensor 135*a* has reached a peak (hereinafter referred to as the lower peak), convex downward (on the rich side on which the value of the air-fuel ratio AF is small), of the periodic variation of the air-fuel ratio AF (step S130). In this embodiment, whether the air-fuel ratio AF has reached the lower peak is determined based on whether the difference obtained by subtracting the air-fuel ratio AF received in the preceding execution of step S125 from the air-fuel ratio AF received in the current execution of step S125, which is repeatedly executed in this routine, varies from a value equal to or lower than zero to a positive value.

Figure 8:
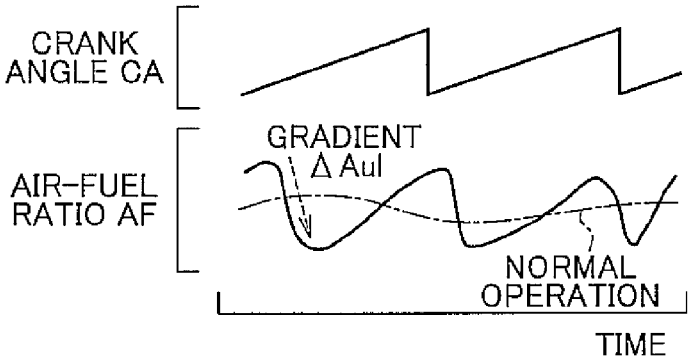
FIG. 8 is an explanatory diagram for explaining an example of a gradient ΔAul.

When the air-fuel ratio AF sent from the air-fuel ratio sensor 135*a* has not reached the lower peak yet, the processes of steps S125 and S130 are repeatedly executed. When the air-fuel ratio AF reaches the lower peak, the air-fuel ratio AF received in the current execution is set as a lower peak air-fuel ratio AL (step S135), and a gradient ΔAul is calculated by dividing, by the time Tul counted by the timer 24*d*, the value obtained by subtracting the set lower peak air-fuel ratio AL from the set upper peak air-fuel ratio AU (step S140). An example of the gradient ΔAul is shown in FIG. 8. In FIG. 8, the crank angle CA varies 0 degree to 720 degrees every one cycle of the engine 22. With regard to the air-fuel ratio AF, the solid line shows an example of the behavior when the engine 22 is in the air-fuel ratio imbalance state, and the chain line shows an example of the behavior when the engine 22 is not in the air-fuel ratio imbalance state. It is considered that the variation of the air-fuel ratio AF as shown by the example in FIG. 8 occurs due to abnormal operation of the fuel injection valve(s) 126 and the intake valve(s) 128 of part of the cylinders. For this reason, as a rule, the variation periodically occurs every period of time corresponding to one cycle of the engine 22.

Next, the gradient accumulation value ΔAuls is set by updating the gradient accumulation value ΔAuls by adding the calculated gradient ΔAul to the gradient accumulation value ΔAuls, which is the accumulation value of the gradient ΔAul (step S145), the counter Cul is incremented (step S150), and it is determined whether the counter Cul has reached a predetermined number N (step S155). When the counter Cul has not reached the predetermined number N, the process returns to step S105 and the processes of steps S105 to S155 are executed. When the counter Cul reaches the predetermined number N, the gradient accumulation average value ΔAulsa is calculated by dividing the set gradient accumulation value ΔAuls by the predetermined number N (step S160). Thus, the gradient accumulation average value ΔAulsa is calculated as the average value of a predetermined number N of values of the gradient ΔAul from the upper peak to the lower peak of the periodic variation of the air-fuel ratio AF sent from the air-fuel ratio sensor 135*a*. Note that used as the predetermined number N is a value such that the gradient from the upper peak to the lower peak of the variation of the air-fuel ratio AF is correctly obtained (for example, the predetermined number N is 5, 10, or 20), the value being determined in advance through experiments and the like based on, for example, characteristics of the engine 22.

After the gradient accumulation average value ΔAulsa is calculated as described above, it is determined whether the calculated gradient accumulation average value ΔAulsa is less than a negative threshold value ΔAref1 (step S165). The threshold value ΔAref1 is used to determine the occurrence of the air-fuel ratio imbalance state of the engine 22. Used as the threshold value ΔAref1 is the lower limit value (the absolute value of which is the upper limit value) of the range, in which it may be determined that the air-fuel ratio is even between the cylinders of the engine 22, the lower limit value being determined in advance through experiments and the like based on, for example, characteristics of the engine 22 and the air-fuel ratio sensor 135*a*. In the embodiment, used as the threshold value ΔAref1 is a value corresponding to the case where the fuel injection amount in one of the four cylinders is, for example, 5% greater than the fuel injection amount of the remaining three cylinders. When the gradient accumulation average value ΔAulsa is greater than the negative threshold value ΔAref1, it is determined that the engine 22 is not in the air-fuel ratio imbalance state, the process returns to step S100, and the processes of steps S100 to S165 are executed. When the gradient accumulation average value ΔAulsa is less than the negative threshold value Δref1, it is determined that the engine 22 is in the air-fuel ratio imbalance state, an imbalance rate R1 is set based on the gradient accumulation average value ΔAulsa (step S170), a gradient determination flag F1 that has the initial value of zero, is set to 1 (step S175), and then the first determination process routine is ended. Thus, when it is determined that the engine 22 is not in the air-fuel ratio imbalance state, the gradient accumulation average value ΔAulsa, which is the average value of a predetermined number N of values of the gradient from the upper peak to the lower peak of the variation of the air-fuel ratio AF, is repeatedly calculated until it is determined that the engine 22 is in the air-fuel ratio imbalance state. Once it is determined that the engine 22 is in the air-fuel ratio imbalance state, the imbalance rate R1 is set and the gradient determination flag F1 is set to 1, and then the first determination process is ended. The imbalance rate R1 herein indicates the degree of imbalance in air-fuel ratio between the cylinders of the engine 22. In the embodiment, the degree of imbalance in air-fuel ratio is expressed by the rate (10%, 20%, or 30%, for example) that indicates how much the fuel injection amount of one of the four cylinders is greater than the fuel injection amount of the remaining three cylinders. In the embodiment, the imbalance rate R1 is set as follows: the relation between the gradient accumulation average value ΔAulsa and the imbalance rate R1 is determined in advance and stored in the ROM 24*b* in the form of an imbalance rate setting map; when the gradient accumulation average value ΔAulsa is given, the corresponding imbalance rate R1 is derived from the stored map. With such a process, it is possible to determine the occurrence of the air-fuel ratio imbalance state easier than the case of a process that requires proper design of the observer and/or various calculations to determine the occurrence of the air-fuel ratio imbalance state. The first determination process has been described above.

Figure 9:
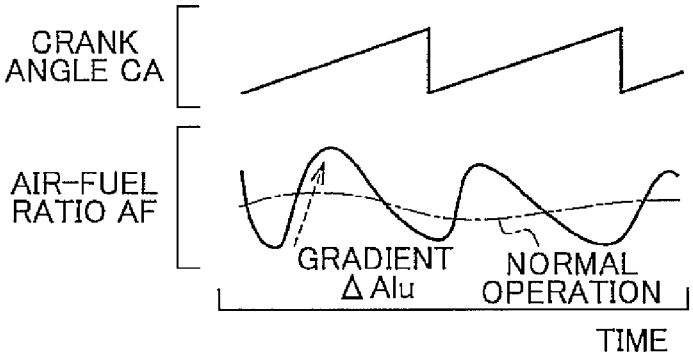
FIG. 9 is an explanatory diagram for explaining an example of a gradient ΔAlu.

Next, the second determination process will be described. While, in the first determination process shown in FIG. 4, the gradient accumulation average value ΔAulsa, which is the average value of a predetermined number N of values of the gradient ΔAul from the upper peak to the lower peak of the variation of the air-fuel ratio AF is calculated with the use of the counter Cul, the time Tul, the gradient accumulation value ΔAuls, etc., the imbalance rate R1 is set based on the gradient accumulation average value ΔAulsa by comparing the calculated gradient accumulation average value ΔAulsa with the negative threshold value ΔAref1, and the gradient determination flag F1 is set, in the second determination process routine shown in FIG. 5, a similar process is executed using a gradient ΔAlu from the lower peak to the upper peak of the variation of the air-fuel ratio AF instead of using the gradient ΔAul, from the upper peak to the lower peak of the variation of the air-fuel ratio AR. An example of the gradient ΔAlu is shown in FIG. 9. Specifically, in the second determination process routine, a gradient accumulation average value ΔAlusa, which is the average value of a predetermined number N of values of the gradient ΔAlu from the lower peak to the upper peak of the variation of the air-fuel ratio AF, is calculated with the use of a counter Clu, a time Tlu, a gradient accumulation value ΔAlus, etc. (steps S200 to S260), an imbalance rate R2 is set based on the gradient accumulation average value ΔAlusa by comparing the calculated gradient accumulation average value ΔAlusa with a positive threshold value ΔAref2, and a gradient determination flag F2 is set (steps S265 to S275). Thus, in order to avoid the redundant explanation in relation to the first determination process, more detailed description of the second determination process is omitted. With such a process, it is possible to determine the occurrence of the air-fuel ratio imbalance state easier.

Figure 6:
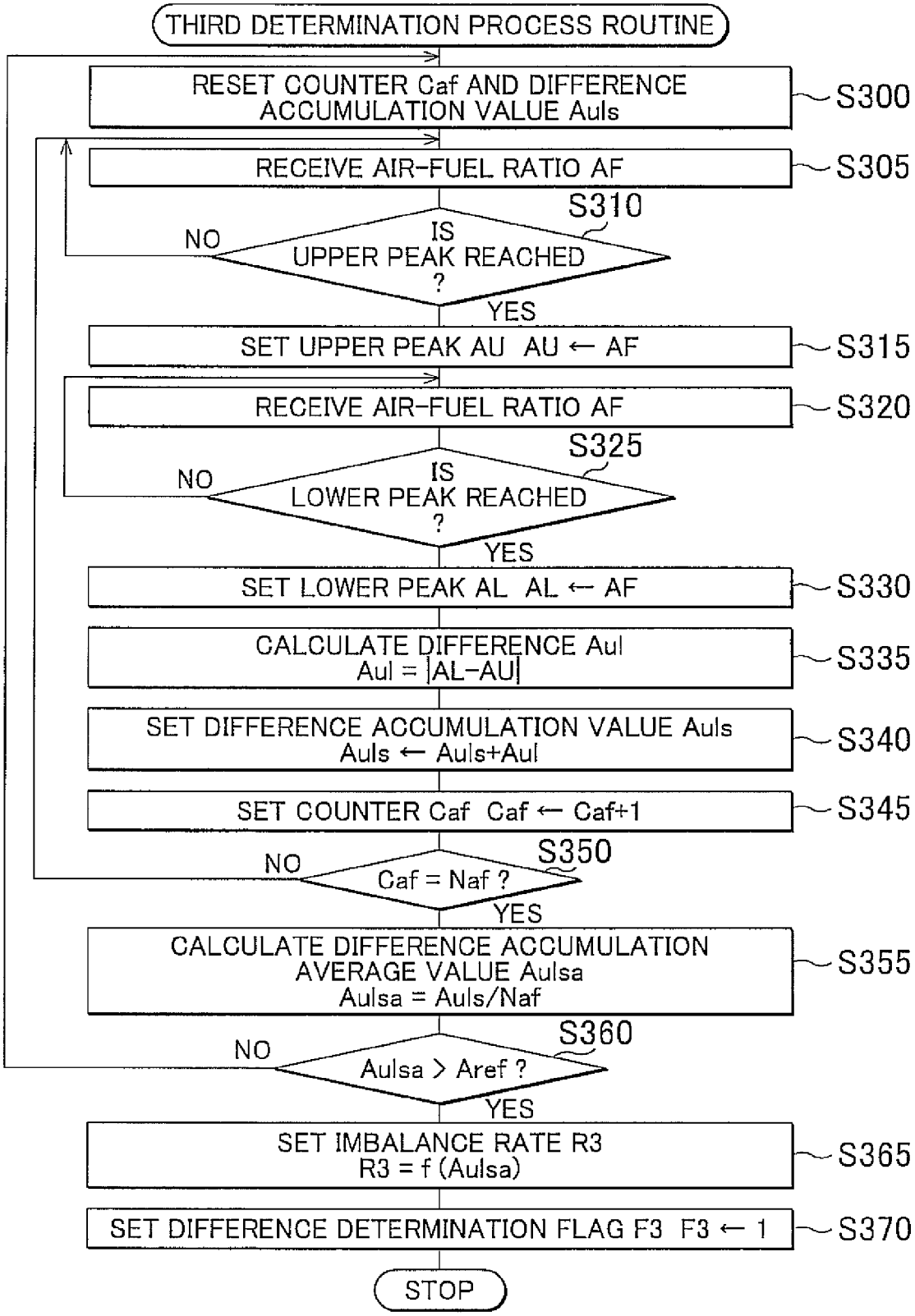
FIG. 6 is a flow chart showing an example of a third determination process routine to be executed by the engine ECU 24.
Figure 10:
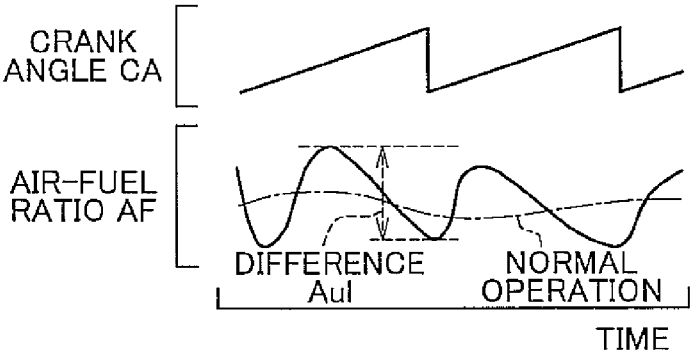
FIG. 10 is an explanatory diagram for explaining an example of a difference Aul.

Next, the third determination process will be described. When the third determination process routine shown in FIG. 6 is executed, the CPU 24*a* of the engine ECU 24 first resets both a counter Caf used in this routine and a difference accumulation value Auls to be described later to zero (step S300), receives the air-fuel ratio AF sent from the air-fuel ratio sensor 135*a* and waits until the air-fuel ratio AF reaches the upper peak (steps S305 and S310), and, when the air-fuel ratio AF reaches the upper peak, sets the air-fuel ratio AF received in the current execution of the process as the upper peak air-fuel ratio AU (step S315). Subsequently, the CPU 24*a* of the engine ECU 24 receives the air-fuel ratio AF sent from the air-fuel ratio sensor 135*a* and waits until the air-fuel ratio AF reaches the lower peak (steps S320 and S325). When the air-fuel ratio AF reaches the lower peak, the CPU 24*a* of the engine ECU 24 sets the air-fuel ratio AF received in the current execution of the process as the lower peak air-fuel ratio AL (step S330), and calculates a difference Aul as the absolute value of the value obtained by subtracting the set lower peak air-fuel ratio AL from the set upper peak air-fuel ratio AU (step S335). An example of the difference Aul is shown in FIG. 10.

After the difference Aul is calculated in this way, the difference accumulation value Auls is set by updating the difference accumulation value Auls by adding the calculated difference Aul to the difference accumulation value Auls, which is the accumulation value of the difference Aul (step 340), a counter Caf is incremented (step S345), and it is determined whether the counter Caf has reached a predetermined number Naf (step S350). When the counter Caf has not reached the predetermined number Naf yet, the process returns to step S305 and the processes of steps S305 to S350 are executed. When the counter Caf reaches the predetermined number Naf, a difference accumulation average value Aulsa is calculated by dividing the set difference accumulation value Auls by the predetermined number Naf (step S355). Thus, the difference accumulation average value Aulsa is calculated as the average value of a predetermined number Naf of values of the difference Aul between the upper peak and the lower peak of the periodic variation of the air-fuel ratio AF sent from the air-fuel ratio sensor 135*a*. Note that used as the predetermined number Naf is a value such that the difference between the upper peak and the lower peak of the variation of the air-fuel ratio AF is correctly obtained (for example, the predetermined number Naf is 5, 10, or 20), the value being determined in advance through experiments and the like based on, for example, characteristics of the engine 22.

After the difference accumulation average value Aulsa is calculated in this way, it is determined whether the calculated difference accumulation average value Aulsa is greater than a positive threshold value Aref (step S360). The threshold value Aref is used to determine the occurrence of the air-fuel ratio imbalance state of the engine 22. Used as the threshold value Aref is the upper limit value of the range, in which it may be determined that the air-fuel ratio is even between the cylinders of the engine 22, the upper limit value being determined in advance through experiments and the like based on, for example, characteristics of the engine 22 and the air-fuel ratio sensor 135*a*. Used as the threshold value Aref in the embodiment is a value corresponding to the case where the fuel injection amount in one of the four cylinders is, for example, 5% greater than the fuel injection amount of the remaining three cylinders as in the case of the threshold values ΔAref1 and ΔAref2 described above. When the difference accumulation average value Aulsa is equal to or lower than the threshold value Aref, it is determined that the engine 22 is not in the air-fuel ratio imbalance state and the process returns to step S300 and the processes of steps S300 to S360 are executed. When the difference accumulation average value Aulsa is greater than the threshold value Aref, it is determined that the engine 22 is in the air-fuel ratio imbalance state, an imbalance rate R3 is set based on the difference accumulation average value Aulsa (step S365), a difference determination flag F3 that has the initial value of zero, is set to 1 (step S370), and then the third determination process routine is ended. Thus, when it is determined that the engine 22 is not in the air-fuel ratio imbalance state, the difference accumulation average value Aulsa, which is the average value of a predetermined number Naf of values of the difference between the upper peak and the lower peak of the variation of the air-fuel ratio AF, is repeatedly calculated until it is determined that the engine 22 is in the air-fuel ratio imbalance state. Once it is determined that the engine 22 is in the air-fuel ratio imbalance state, the imbalance rate R3 is set and the gradient determination flag F3 is set to 1, and then the third determination process is ended. The imbalance rate R3 herein indicates the degree of imbalance in air-fuel ratio between the cylinders of the engine 22. In the embodiment, the degree of imbalance in air-fuel ratio is expressed by the rate that indicates how much the fuel injection amount of one of the four cylinders is greater than the fuel injection amount of the remaining three cylinders. In the embodiment, the imbalance rate R3 is set as follows: the relation between the difference accumulation average value Aulsa and the imbalance rate R3 is determined in advance and stored in the ROM 24*b* in the form of an imbalance rate setting map; when the difference accumulation average value Aulsa is given, the corresponding imbalance rate R3 is derived from the stored map. Such a process also makes it possible to determine the occurrence of the air-fuel ratio imbalance state. The third determination process has been described above.

Figure 7:
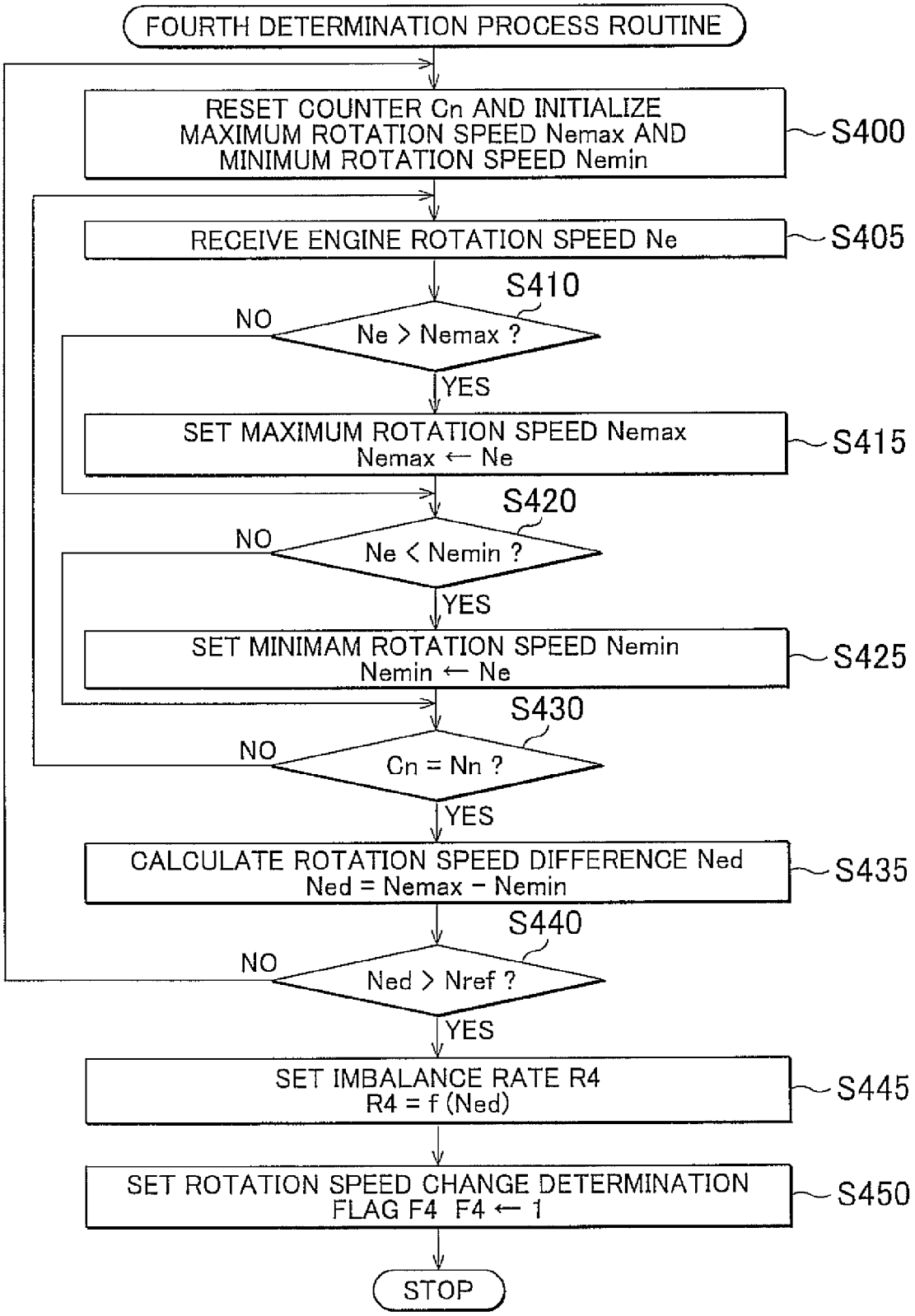
FIG. 7 is a flow chart showing an example of a fourth determination process routine to be executed by the engine ECU 24.

Next, the fourth determination process will be described. When the fourth determination process routine shown in FIG. 7 is executed, the CPU 24*a* of the engine ECU 24 first resets a counter Cn used in this routine to zero and initializes a maximum rotation speed Nemax and a minimum rotation speed Nemin to be set in this routine, to the target rotation speed of the engine 22 (which is, for example, the rotation speed Nset for warming up in the predetermined steady operating state of the engine 22) (step S400). After being reset to zero, the counter Cn is incremented every one cycle of the engine 22. Whether one cycle of the engine 22 has been completed can be determined based on the crank angle CA sent from the crank position sensor 140. Subsequently, the CPU 24*a* of the engine ECU 24 receives the current rotation speed Ne of the engine 22 calculated based on the crank angle CA (step S405), compares the received rotation speed Ne of the engine 22 with the maximum rotation speed Nemax (step S410), and, when the rotation speed Ne of the engine 22 is higher than the maximum rotation speed Nemax, sets the current rotation speed Ne as the maximum rotation speed Nemax (step S415). When the rotation speed Ne of the engine 22 is equal to or lower than the maximum rotation speed Nemax, or when the rotation speed Ne of the engine 22 is higher than the maximum rotation speed Nemax and the current rotation speed Ne of the engine 22 is set as the maximum rotation speed Nemax, the CPU 24*a* of the engine ECU 24 compares the rotation speed Ne of the engine 22 with the minimum rotation speed Nemin (step S420), and when the rotation speed Ne of the engine 22 is lower than the minimum rotation speed Nemin, the current rotation speed Ne is set as the minimum rotation speed Nemin and the process proceeds to the next step (step S425). When the rotation speed Ne of the engine 22 is equal to or higher than the minimum rotation speed Nemin, the process proceeds to the next step.

Figure 11:
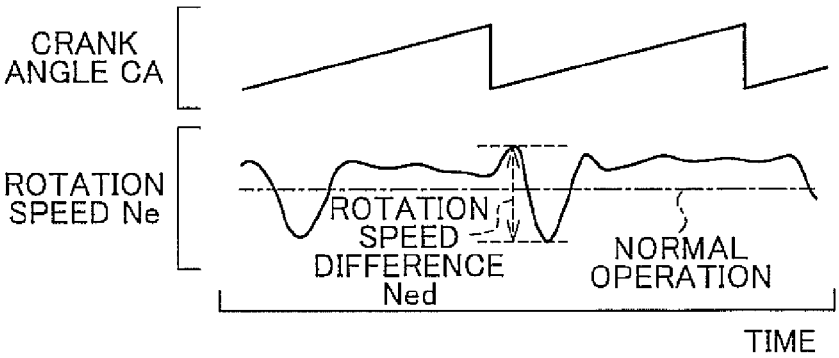
FIG. 11 is an explanatory diagram for explaining an example of a rotation speed difference Ned.

After the maximum rotation speed Nemax and the minimum rotation speed Nemin are set in this way, it is determined whether the counter Cn that is incremented every one cycle of the engine 22 after the counter Cn is reset at step S400 has reached a predetermined number Nn (step S430). Note that used as the predetermined number Nn is a value such that the occurrence of the air-fuel ratio imbalance state is correctly determined based on the difference between the maximum value and the minimum value of the periodic variation of the rotation speed Ne of the engine 22 (for example, the predetermined number Nn is 5, 10, or 20), the value being determined in advance through experiments and the like based on, for example, characteristics of the engine 22. When the counter Cn has not reached the predetermined number Nn yet, the process returns to step S405 and the processes of steps S405 to S430 are executed. When the counter Cn reaches the predetermined number Nn, a rotation speed difference Ned is calculated by subtracting the minimum rotation speed Nemin from the maximum rotation speed Nemax (step S435) and the calculated rotation speed difference Ned is compared with a threshold value Nref (step S440). The threshold value Nref is used to determine the occurrence of the air-fuel ratio imbalance state of the engine 22. Used as the threshold value. Nref is the upper limit value of the range, in which it may be determined that the air-fuel ratio is even between the cylinders of the engine 22, the upper limit value being determined in advance through experiments and the like based on, for example, characteristics of the engine 22 and the air-fuel ratio sensor 135*a*. Used as the threshold value Nref in the embodiment is a value corresponding to the case where the fuel injection amount in one of the four cylinders is, for example, 5% greater than the fuel injection amount of the remaining three cylinders as in the cases of the threshold values ΔAref1, ΔAref2, and Aref. An example of the rotation speed difference Ned is shown in FIG. 11. As a rule, the variation of the rotation speed Ne of the engine 22 as shown by the example in FIG. 11 also periodically occurs every period of time corresponding to one cycle of the engine 22 as in the case of the variation of the air-fuel ratio AF as shown by the examples in FIGS. 8 to 10.

When the rotation speed difference Ned is equal to or less than the threshold value Nref, it is determined that the engine 22 is not in the air-fuel ratio imbalance state, and the process returns to step S400 to execute the processes of steps S400 to S440. When the rotation speed difference Ned is greater than the threshold value Nref, it is determined that the engine 22 is in the air-fuel ratio imbalance state, an imbalance rate R4 is set based on the rotation speed difference Ned (step S445), a rotation speed change determination flag F4 that has the initial value of zero, is set to 1 (step S450), and then the fourth determination process routine is ended. Thus, when it is determined that the engine 22 is not in the air-fuel ratio imbalance state, the rotation speed difference Ned between the maximum rotation speed Nemax and the minimum rotation speed Nemin during a predetermined number Nn of cycles of the engine 22 is repeatedly calculated until it is determined that the engine 22 is in the air-fuel ratio imbalance state. Once it is determined that the engine 22 is in the air-fuel ratio imbalance state, the imbalance rate R4 is set and the rotation speed change determination flag F4 is set to 1, and then the fourth determination process is ended. The imbalance rate R4 herein indicates the degree of imbalance in air-fuel ratio between the cylinders of the engine 22. In the embodiment, the degree of imbalance in air-fuel ratio is expressed by the rate that indicates how much the fuel injection amount of one of the four cylinders is greater than the fuel injection amount of the remaining three cylinders as in the cases of the imbalance rates R1, R2, and R3 described above. In the embodiment, the imbalance rate R4 is set as follows: the relation between the rotation speed difference Ned and the imbalance rate R4 is determined in advance and stored in the ROM 24*b* in the form of an imbalance rate setting map; when the rotation speed difference Ned is given, the corresponding imbalance rate R4 is derived from the stored map. Such a process also makes it possible to determine the occurrence of the air-fuel ratio imbalance state. The fourth determination process has been described above.

Figure 12:
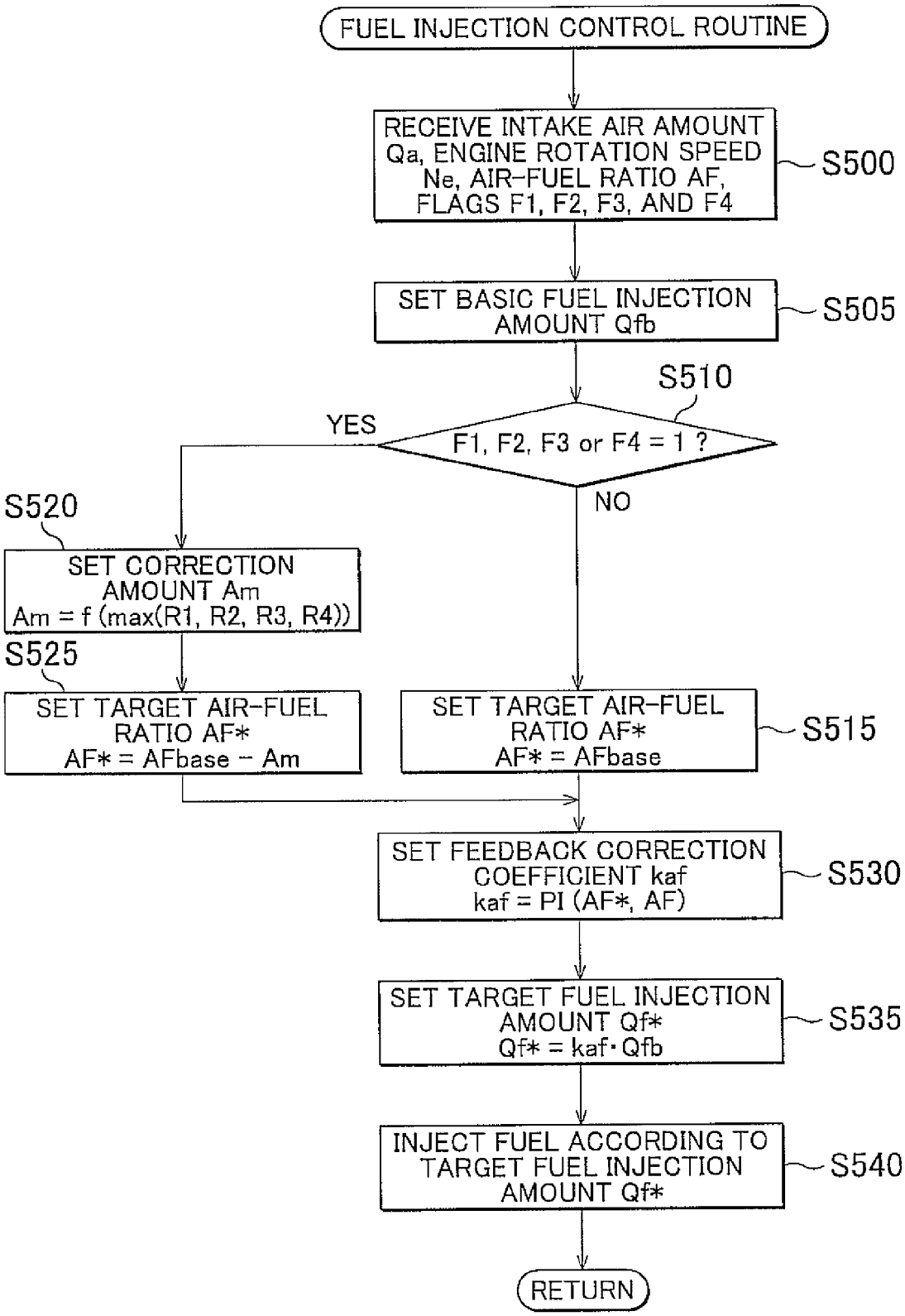
FIG. 12 is a flow chart showing an example of a fuel injection control routine to be executed by the engine ECU 24.

Next, fuel injection control performed with the use of the result of determination of the air-fuel ratio imbalance state will be described. FIG. 12 is a flow chart showing an example of a fuel injection control routine that is repeatedly executed every predetermined period of time (every few milliseconds, for example) by the engine ECU 24.

Once the fuel injection control routine is executed, the CPU 24*a* of the engine ECU 24 receives the data required to perform control, such as the intake air amount Qa sent from the air flow meter 148, the rotation speed Ne of the engine 22, and the gradient determination flags F1 and F2, the difference determination flag F3, and the rotation speed change determination flag F4 that each have the initial value of zero, and that are set to 1 by the first to fourth determination process routines for determining the occurrence of the air-fuel ratio imbalance state (step S500), and the CPU 24*a* of the engine ECU 24 sets a basic fuel injection amount Qfb, which is the basic value of the fuel injection amount that is set to make the air-fuel ratio of the engine 22 the stoichiometric air-fuel ratio, based on the received intake air amount Qa and rotation speed Ne (step S505). In the embodiment, the basic fuel injection amount Qfb is set as follows: the relation between the intake air amount Qa and the rotation speed Ne of the engine 22, and the basic fuel injection amount Qfb is determined in advance and stored in the ROM 24*b* in the form of a basic fuel injection amount setting map; when the intake air amount Qa and the rotation speed Ne are given, the corresponding basic fuel injection amount Qfb is derived from the stored map.

Subsequently, each of the input gradient determination flags F1 and F2, difference determination flag F3, and rotation speed change determination flag F4 is checked (step S510). When all the four flags received are zero, it is determined that the engine 22 is not in the air-fuel ratio imbalance state, and a basic air-fuel ratio AFbase, which is the stoichiometric air-fuel ratio, is set as a target air-fuel ratio AF* (step S515). Then, a feedback correction coefficient kaf is set using the following equation (1), which expresses the relation used in feedback control so that the received AIR-FUEL RATIO AF is brought to the set target air-fuel ratio AF* (step S530), a target fuel injection amount Qf* is set by multiplying the basic fuel injection amount Qfb by the set feedback correction coefficient kaf (step S535), the fuel injection valves 126 of the respective cylinders are driven so that fuel is injected according to the set target fuel injection amount Qf* (step S540), and then the fuel injection control routine is ended. In the equation (1), the second term, k1, in the right hand side represents the gain of the proportional term, and the third term, k2, in the right hand side represents the gain of the integral term. Such control makes it possible to perform fuel injection into the engine 22 so that the air-fuel ratio AF sent from the air-fuel ratio sensor 135*a* is brought to the target air-fuel ratio AF*, which is the stoichiometric air-fuel ratio.

$$kaf=kaf+k1(AF^*-AF)+k2\int(AF^*-AF)dt \quad (1)$$

Figure 13:
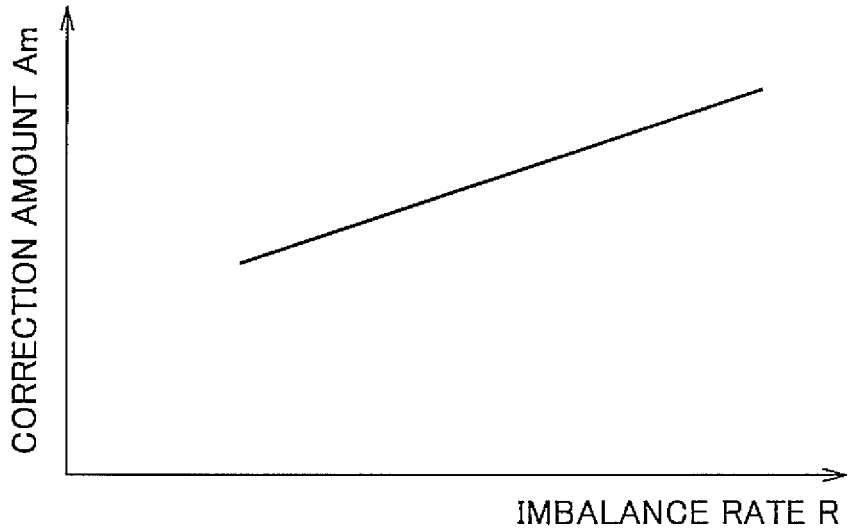
FIG. 13 is an explanatory diagram showing an example of a correction amount setting map.

On the other hand, when at least one of the four flags received has a value of 1, it is determined that the engine 22 is in the air-fuel ratio imbalance state. In this case, a correction amount Am is set based on the maximum value among the imbalance rates R1 to R4, each of which is set to a rate, such as 10%, 20%, or 30%, along with the flags F1 to F4 that each have the initial value of zero, and that are set in the first to fourth determination process routines (step S520), and the value obtained by subtracting the correction amount Am from the basic air-fuel ratio AFbase, which is the stoichiometric air-fuel ratio is set as the target air-fuel ratio AF* (step S525). The correction amount Am is used to suppress deterioration of the exhaust emission from the engine 22 due to the air-fuel ratio imbalance state. In the embodiment, the correction amount Am is set as follows: the relation between the imbalance rate R that is the maximum value among the imbalance rates R1 to R4 and the correction amount Am is determined in advance and stored in the ROM 24*b* in the form of a correction amount setting map; when the imbalance rate R is given, the corresponding correction amount Am is derived from the stored map. FIG. 13 shows an example of the correction amount setting map. In FIG. 13, the correction amount Am is determined so that the larger the imbalance rate R is, the larger the correction amount Am is, such as 1, 1.5, and 2. This is because as the imbalance rate R increases, the emission tends to be deteriorated, because, for example, the amount of fuel injected into part of the cylinders becomes smaller than the amount of fuel injected into the remaining cylinder(s). In the embodiment, the value obtained by subtracting the correction amount Am from the basic air-fuel ratio AFbase is set as the target air-fuel ratio AF* in order to increase the amount of fuel injected into the engine 22 as compared to that when the engine 22 is not in the air-fuel ratio imbalance state but in normal operation to thereby suppress formation of nitrogen oxides (NOx) that can be formed when the air-fuel ratio of part of the cylinders is leaner than the air-fuel ratio of the other cylinder(s).

The feedback correction coefficient kaf is set using the equation (1) using the received air-fuel ratio AF and the set target air-fuel ratio AF* (step S530), the target fuel injection amount Qf* is set by multiplying the basic fuel injection amount Qfb by the set feedback correction coefficient kaf (step S535), the fuel injection valves 126 of the respective cylinders are driven so that fuel is injected according to the set target fuel injection amount Qf* (step S540), and then the fuel injection control routine is ended. Such control makes it possible to, when it is determined that the engine 22 is in the air-fuel ratio imbalance state, inject fuel into the engine 22 so that the air-fuel ratio AF sent from the air-fuel ratio sensor 135*a* is brought to the (rich) target air-fuel ratio AF*, which is smaller than the stoichiometric air-fuel ratio, and thus, such control makes it possible to suppress deterioration of the emission.

According to the internal combustion engine system installed in the hybrid car 20 of the embodiment as described above, when the engine 22 is in the predetermined steady operating state, the gradient accumulation average value ΔAulsa (ΔAlusa) corresponding to the amount of change in the air-fuel ratio AF over the period of time taken from when the air-fuel ratio AF detected by the air-fuel ratio sensor 135*a* reaches the upper peak (lower peak), at which the direction of change in the air-fuel ratio AF is inverted, to when the air-fuel ratio AF reaches the lower peak (upper peak), at which the subsequent inversion of the direction of change in the air-fuel ratio AF occurs, is calculated. When the calculated gradient accumulation average value ΔAulsa (ΔAlusa) is greater than the threshold value ΔAref1 (ΔAref2), it is determined that the engine 22 is in the air-fuel ratio imbalance state, in which there is an imbalance in air-fuel ratio between the cylinders of the engine 22. Thus, it is possible to determine the occurrence of the air-fuel ratio imbalance state easier than the case of a process that requires the observer etc. In addition, such a gradient accumulation average value ΔAulsa (ΔAlusa) is calculated as the average value of a predetermined number N of values of the gradient ΔAul (ΔAlu), so that it is possible to determine the occurrence of the air-fuel ratio imbalance state more correctly. Further, it is possible to determine the occurrence of the air-fuel ratio imbalance state with more reliability because the determination using the difference accumulation average value Aulsa of the air-fuel ratio AF and the determination using the rotation speed difference Ned of the rotation speed Ne of the engine 22 are made in addition to the determination using the gradient accumulation average value ΔAulsa (ΔAlusa) of the air-fuel ratio AF. Moreover, when it is determined that the engine 22 is in the air-fuel ratio imbalance state, fuel injection control is performed so that the fuel injection amount of the engine 22 increases as compared, to the case where it is determined that the engine 22 is not in the air-fuel ratio imbalance state. Thus, it is possible to suppress deterioration of the emission.

In the internal combustion engine system installed in the hybrid car 20 of the embodiment, the gradient accumulation average value ΔAulsa (ΔAlusa) corresponding to the amount of change in the air-fuel ratio AF over the period of time taken from when the air-fuel ratio AF detected by the air-fuel ratio sensor 135*a* reaches the upper peak (lower peak), at which the direction of change in the air-fuel ratio AF is inverted, to when the air-fuel ratio AF reaches the lower peak (upper peak), at which the subsequent inversion of the direction of change in the air-fuel ratio AF occurs, is calculated and the occurrence of the air-fuel ratio imbalance state is determined by comparing the calculated value with the threshold value. However, any configurations may be employed as long as the occurrence of the air-fuel ratio imbalance state is determined by comparing the amount of change per unit time in the air-fuel ratio AF sent from the air-fuel ratio sensor 135*a* with a threshold value, such as a configuration, in which a plurality of amounts of change per unit time in the air-fuel ratio AF during the period of time (a dozen or so seconds or several dozen seconds, for example) taken from when the air-fuel ratio AF detected by the air-fuel ratio sensor 135*a* reaches the upper peak (lower peak), at which the direction of change in the air-fuel ratio AF is inverted, to when the air-fuel ratio AF reaches the lower peak (upper peak), at which the subsequent inversion of the direction of change in the air-fuel ratio AF occurs, are calculated and the maximum value among the calculated values (amounts) is compared with the threshold value to determine the occurrence of the air-fuel ratio imbalance state.

In the internal combustion engine system installed in the hybrid car 20 of the embodiment, the gradient accumulation average value ΔAulsa (ΔAlusa) of the air-fuel ratio AF sent from the air-fuel ratio sensor 135*a* is calculated as the average value of a predetermined number N of values of the gradient ΔAul (ΔAlu) and the calculated gradient accumulation average value ΔAulsa (ΔAlusa) is compared with the threshold value to determine the occurrence of the air-fuel ratio imbalance state. However, the occurrence of the air-fuel ratio imbalance state may be determined by calculating the gradient accumulation average value ΔAulsa (ΔAlusa) as the maximum value among a predetermined number N of values of the gradient ΔAul (ΔAlu) and comparing the calculated value of the gradient accumulation average value ΔAulsa (ΔAlusa) with a threshold value. Alternatively, the occurrence of the air-fuel ratio imbalance state may be determined by accumulating, or summing, values of the gradient ΔAul (ΔAlu) and, without averaging, comparing the accumulation value itself with a threshold value.

In the internal combustion engine system installed in the hybrid car 20 of the embodiment, the gradient accumulation average value ΔAulsa corresponding to the amount of change in the air-fuel ratio AF over the period of time taken from when the air-fuel ratio AF detected by the air-fuel ratio sensor 135*a* reaches the upper peak, at which the direction of change in the air-fuel ratio AF is inverted, to when the air-fuel ratio AF reaches the lower peak, at which the subsequent inversion of the direction of change in the air-fuel ratio AF occurs, and the gradient accumulation average value ΔAlusa corresponding to the amount of change in the air-fuel ratio AF over the period of time taken from when the air-fuel ratio AF detected by the air-fuel ratio sensor 135*a* reaches the lower peak, at which the direction of change in the air-fuel ratio AF is inverted, to when the air-fuel ratio AF reaches the upper peak, at which the subsequent inversion of the direction of change in the air-fuel ratio AF occurs, are calculated and the occurrence of the air-fuel ratio imbalance state is determined by comparing the calculated values with respective threshold values. However, a configuration may be employed, in which one of the gradient accumulation average value ΔAulsa and the gradient accumulation average value ΔAlusa is calculated and the calculated value is compared with a threshold value to determine the occurrence of the air-fuel ratio imbalance state.

In the internal combustion engine system installed in the hybrid car 20 of the embodiment, the determination using the difference accumulation average value Aulsa of the air-fuel ratio AF and the determination using the rotation speed difference Ned of the rotation speed Ne of the engine 22 are made in addition to the determination using the gradient accumulation average value ΔAulsa (ΔAlusa) of the air-fuel ratio AF. However, a configuration may be employed, in which one of the determination using the difference accumulation average value Aulsa of the air-fuel ratio AF and the determination using the rotation speed difference Ned of the rotation speed Ne of the engine 22 only is made, or a configuration may be employed, in which neither of these determinations is made.

In the internal combustion engine system installed in the hybrid car 20 of the embodiment, when it is determined that the engine 22 is in the air-fuel ratio imbalance state, fuel injection control is performed so that the fuel injection amount of the engine 22 increases as compared to the case where it is determined that the engine 22 is not in the air-fuel ratio imbalance state and so that the larger the imbalance rate R is, the greater the fuel injection amount of the engine 22 is. However, a configuration may be employed, in which, when it is determined that the engine 22 is in the air-fuel ratio imbalance state, fuel injection control is performed so that, regardless of the imbalance rate R, the fuel injection amount of the engine 22 is greater by a predetermined correction amount than that when it is determined that the engine 22 is not in the air-fuel ratio imbalance state. Instead of performing such fuel injection control, in the case of an internal combustion engine system, in which the fuel injection amount is adjusted based on oxygen signal O2 sent from the oxygen sensor 135*b* installed downstream of the purification device 134, the fuel injection amount may be adjusted based on the oxygen signal O2 when it is determined that the engine 22 is in the air-fuel ratio imbalance state, or the intake air amount may be adjusted by adjusting the throttle valve opening degree when it is determined that the engine 22 is in the air-fuel ratio imbalance state.

In the internal combustion engine system installed in the hybrid car 20 of the embodiment, the predetermined steady operating state of the engine 22, in which the process for determining the occurrence of the air-fuel ratio imbalance state is executed, is a state where operation for warming up the catalyst of the purification device 134 is being performed and operation for warming up the engine 22 is being performed immediately after the ignition switch is turned on. However, the predetermined steady operating state is not limited as long as the engine 22 is in a state, in which the engine 22 is in steady operation. For example, the predetermined steady operating state may be a state where both the rotation speed Ne and the intake air amount Qa of the engine 22 are within a predetermined range, in which it may be determined that the engine 22 is in steady operation, while the vehicle is running.

In the internal combustion engine system installed in the hybrid car 20 of the embodiment, the engine 22 is configured as a four-cylinder internal combustion engine, in which each of the cylinders is provided with the fuel injection valve 126. However, the number of cylinders may be any number as long as the engine 22 is configured as a multi-cylinder internal combustion engine, such as a 6-cylinder engine or an 8-cylinder engine, in which fuel injection is performed for each of the cylinders.

Although the above embodiment is described in the case of the hybrid car 20 installed with the internal combustion engine system, the invention may be embodied as an internal combustion engine system that is installed in a car that is driven by outputting the motive power supplied from the engine to the drive shaft via a transmission, or a mobile body, such as a vehicle other than such a car, a ship, or an air plane, or may be embodied as an internal combustion engine system that is installed in a fixed facility. The invention may be embodied as a method of determining air-fuel ratio imbalance in such an internal combustion engine system.

The correspondences between the main components of the embodiment and the main components of the invention will be described. In the embodiment, the four-cylinder engine 22 functions as the "internal combustion engine", the air-fuel ratio sensor 135*a* provided in the exhaust pipe 133 functions as the "air-fuel ratio detection device", and what functions as the "air-fuel ratio state determination section" is the engine ECU 24 that performs the first determination process routine shown in FIG. 4, in which, when the engine 22 is in the predetermined steady operating state, the gradient accumulation average value ΔAulsa of the air-fuel ratio AF sent from the air-fuel ratio sensor 135*a* is calculated and when the calculated gradient accumulation average value ΔAulsa is less than the threshold value ΔAref1, it is determined that the engine 22 is in the air-fuel ratio imbalance state, and performs the second determination process routine shown in FIG. 5, in which, when the engine 22 is in the predetermined steady operating state, the gradient accumulation average value ΔAlusa of the air-fuel ratio AF sent from the air-fuel ratio sensor 135*a* is calculated and when the calculated gradient accumulation average value ΔAlusa is greater than the threshold value ΔAref2, it is determined that the engine 22 is in the air-fuel ratio imbalance state. What functions as the "controller" is the engine ECU 24 that performs the fuel injection control routine shown in FIG. 12, in which control is performed so that, when it is determined that the engine 22 is in the air-fuel ratio imbalance state, the fuel injection amount of the engine 22 becomes greater than the fuel injection amount set according to the target air-fuel ratio AF*, which is the basic air-fuel ratio AFbase when it is determined that the engine 22 is not in the air-fuel ratio imbalance state, wherein the target air-fuel ratio AF* is obtained by subtracting the correction amount Am, set based on the imbalance rate R, from the basic air-fuel ratio AFbase.

The "internal combustion engine" is not limited to the four-cylinder engine 22 but may be any type of internal combustion engine as long as it is a multi-cylinder internal combustion engine, in which fuel injection is performed for each of the cylinders, such as a 6-cylinder engine or an 8-cylinder engine. The "air-fuel ratio detection device" is not limited to the air-fuel ratio sensor 135*a* provided in the exhaust pipe 133 but may be any type of sensor for detecting the air-fuel ratio that is provided in the exhaust pipe, at which the flows of exhaust gas from the respective cylinders of the internal combustion engine are combined. The "air-fuel ratio state determination section" is not limited to a means that, when the engine 22 is in the predetermined steady operating state, calculates the gradient accumulation average value ΔAulsa and the gradient accumulation average value ΔAlusa of the air-fuel ratio AF sent from the air-fuel ratio sensor 135*a* and determines that the engine 22 is in the air-fuel ratio imbalance state when, the calculated gradient accumulation average value ΔAulsa and/or gradient accumulation average value ΔAlusa go(es) beyond the threshold value(s). The "air-fuel ratio state determination section" may be any type of means that, when the amount of change per unit time in the air-fuel ratio detected when the internal combustion engine is in the predetermined steady operating state is not within a predetermined range, determines that the internal combustion engine is in the air-fuel ratio imbalance state, in which there is an imbalance in air-fuel ratio between the cylinders of the internal combustion engine. The "controller" is not limited to a controller that performs control so that, when it is determined that the engine 22 is in the air-fuel ratio imbalance state, the fuel injection amount of the engine 22 becomes greater than the fuel injection amount set according to the target air-fuel ratio AF*, which is the basic air-fuel ratio AFbase when it is determined that the engine 22 is not in the air-fuel ratio imbalance state, wherein the target air-fuel ratio AF* is obtained by subtracting the correction amount Am, set based on the imbalance rate R, from the basic air-fuel ratio AFbase. The "controller" may be any type of controller that controls the internal combustion engine so that, when the air-fuel ratio state determination section determines that the internal combustion engine is in the air-fuel ratio imbalance state, the fuel injection amount of the internal combustion engine becomes greater than that when it is determined that the internal combustion engine is not in the air-fuel ratio imbalance state.

The above correspondences between the main components of the embodiment and the main components of the invention are examples for specifically describing the mode for carrying out the invention and therefore, the correspondences are not intended to limit the components of the invention. In other words, the invention should be interpreted based on the claims and the embodiment is merely a concrete example of the invention.

While a mode for carrying out the invention has been described above, referring to the embodiment, the invention is not limited to such an embodiment and it goes without saying that the invention may be embodied in various forms without departing from the scope of the invention In the internal combustion engine system of the invention, the air-fuel ratio state determination section may use, as the amount of change per unit time in the detected air-fuel ratio, a value obtained by dividing the amount of change in the detected air-fuel ratio over a predetermined period of time from when a direction of change in the detected air-fuel ratio is inverted to when the subsequent inversion of the direction of change in the air-fuel ratio occurs, by the predetermined period of time. With this configuration, it becomes possible to determine the occurrence of the air-fuel ratio imbalance state more correctly.

The internal combustion engine system of the invention may be configured so that the air-fuel ratio state determination section calculates the amount of change per unit time in the detected air-fuel ratio a plurality of times and, when an average value of the amounts of change obtained by calculating the amount of change the plurality of times is not within the predetermined range, the air-fuel ratio state determination section determines that the internal combustion engine is in the air-fuel ratio imbalance state. With this configuration, it becomes possible to determine the occurrence of the air-fuel ratio imbalance state more correctly.

The internal combustion engine system of the invention may be configured so that the air-fuel ratio state determination section calculates the amount of change per unit time in the detected air-fuel ratio a plurality of times and, when a maximum value of the amounts of change obtained by calculating the amount of change the plurality of times is not within the predetermined range, the air-fuel ratio state determination section determines that the internal combustion engine is in the air-fuel ratio imbalance state. Alternatively, the internal combustion engine system of the invention may be configured so that the air-fuel ratio state determination section calculates the amount of change per unit time in the detected air-fuel ratio a plurality of times, calculates a sum of the amounts of change obtained by calculating the amount of change the plurality of times, and determines, based on the sum, whether the amount of change per unit time in the detected air-fuel ratio is within the predetermined range.

The internal combustion engine system of the invention may be configured so that, also when the amount of change in the detected air-fuel ratio from when a direction of change in the detected air-fuel ratio is inverted to when the subsequent inversion of the direction of change in the air-fuel ratio occurs, is not within a second predetermined range, the air-fuel ratio state determination section determines that the internal combustion engine is in the air-fuel ratio imbalance state. The internal combustion engine system of the invention may be configured so that, also when a difference between a maximum value and a minimum value of a rotation speed of the internal combustion engine during a plural number of cycles of the internal combustion engine is not within a third predetermined range, the air-fuel ratio state determination section determines that the internal combustion engine is in the air-fuel ratio imbalance state. With these configurations, it becomes possible to determine the occurrence of the air-fuel ratio imbalance state more reliably.

The internal combustion engine system of the invention may further include a controller that, when the air-fuel ratio state determination section determines that the internal combustion engine is in the air-fuel ratio imbalance state, controls the internal combustion engine so that the amount of fuel injected into the internal combustion engine becomes greater than that when the air-fuel ratio state determination section determines that the internal combustion engine is not in the air-fuel ratio imbalance state. With this configuration, it becomes possible to suppress deterioration of emission due to the air-fuel ratio imbalance state.

The internal combustion engine system of the invention may be configured so that, when the air-fuel ratio state determination section determines that the internal combustion engine is in the air-fuel ratio imbalance state, the controller controls the internal combustion engine so that the higher a degree of the imbalance is, the greater the amount of fuel injected into the internal combustion engine becomes.

The invention can be used in the fields of internal combustion engines and vehicle manufacturing industry.

What is claimed is:

1. An internal combustion engine system including a multi-cylinder internal combustion engine, in which fuel injection is performed for each of cylinders, the internal combustion engine system comprising:

an air-fuel ratio detection device that detects an air-fuel ratio and that is provided in an exhaust pipe, at which flows of exhaust gas from the cylinders of the internal combustion engine are combined;

an air-fuel ratio state determination section to make a determination on the air-fuel ratio imbalance state only when the internal combustion engine is in a predetermined steady operating state and an amount of change per unit time in the detected air-fuel ratio is not within a predetermined range, the air-fuel ratio determination section determines that the internal combustion engine is in an air-fuel ratio imbalance state, in which there is an imbalance in air-fuel ratio between the cylinders of the internal combustion engine; and a controller that, when the air-fuel ratio state determination section determines that the internal combustion engine is in the air-fuel ratio imbalance state, controls the internal combustion engine so that an amount of fuel injected into the internal combustion engine becomes greater than that when the air-fuel ratio state determination section determines that the internal combustion engine is not in the air-fuel ratio imbalance state.

2. The internal combustion engine system according to claim 1, wherein the air-fuel ratio state determination section determines whether the internal combustion engine is in the air-fuel ratio imbalance state using, as the amount of change per unit time in the detected air-fuel ratio, a value obtained by dividing the amount of change in the detected air-fuel ratio over a predetermined period of time where the predetermined period of time is a period of time from when the detected air-fuel ratio has reached an upper peak of a periodic variation of the detected air-fuel ratio to when the detected air-fuel ratio has reached a lower peak or a period of time from when the detected air-fuel ratio has reached the lower peak to when the detected air-fuel ratio has reached the upper peak adjacent to the lower peak, by the predetermined period of time.

3. The internal combustion engine system according to claim 1, wherein the air-fuel ratio state determination section calculates the amount of change per unit time in the detected air-fuel ratio a plurality of times and, when an average value of the amounts of change obtained by calculating the amount of change the plurality of times is not within the predetermined range, the air-fuel ratio state determination section determines that the internal combustion engine is in the air-fuel ratio imbalance state.

4. The internal combustion engine system according to claim 1, wherein the air-fuel ratio state determination section calculates the amount of change per unit time in the detected air-fuel ratio a plurality of times and, when a maximum value of the amounts of change obtained by calculating the amount of change the plurality of times is not within the predetermined range, the air-fuel ratio state determination section determines that the internal combustion engine is in the air-fuel ratio imbalance state.

5. The internal combustion engine system according to claim 1, wherein the air-fuel ratio state determination section calculates the amount of change per unit time in the detected air-fuel ratio a plurality of times, calculates a sum of the amounts of change obtained by calculating the amount of change the plurality of times, and determines, based on the sum, whether the amount of change per unit time in the detected air-fuel ratio is within the predetermined range.

6. The internal combustion engine system according to claim 1, wherein also when the amount of change in the detected air-fuel ratio from when the detected air-fuel ratio has reached an upper peak of a periodic variation of the detected air-fuel ratio to when the detected air-fuel ratio has reached a lower peak or from when the detected air-fuel ratio has reached the lower peak to when the detected air-fuel ratio has reached the upper peak adjacent to the lower peak, the air-fuel ratio state determination section determines that the internal combustion engine is in the air-fuel ratio imbalance state.

7. The internal combustion engine system according to claim 1, wherein also when a difference between a maximum value and a minimum value of a rotation speed of the internal combustion engine during a plural number of cycles of the internal combustion engine is not within a third predetermined range, the air-fuel ratio state determination section determines that the internal combustion engine is in the air-fuel ratio imbalance state.

8. The internal combustion engine system according to claim 1, wherein when the air-fuel ratio state determination section determines that the internal combustion engine is in the air-fuel ratio imbalance state, the controller controls the internal combustion engine so that the higher a degree of the imbalance is, the greater the amount of fuel injected into the internal combustion engine becomes.

9. The internal combustion engine system according to claim 1, wherein the amount of change per unit time is a gradient of the detected air-fuel ratio.

10. A vehicle comprising:

an internal combustion engine system including a multi-cylinder internal combustion engine, in which fuel injection is performed for each of cylinders, the internal combustion engine system comprising:

an air-fuel ratio detection device that detects an air-fuel ratio and that is provided in an exhaust pipe, at which flows of exhaust gas from the cylinders of the internal combustion engine are combined;

an air-fuel ratio state determination section to make a determination on the air-fuel ratio imbalance state only when the internal combustion engine is in a predetermined steady operating state and an amount of change per unit time in the detected air-fuel ratio is not within a predetermined range, the air-fuel ratio determination section determines that the internal combustion engine is in an air-fuel ratio imbalance state, in which there is an imbalance in air-fuel ratio between the cylinders of the internal combustion engine; and a controller that, when the air-fuel ratio state determination section determines that the internal combustion engine is in the air-fuel ratio imbalance state, controls the internal combustion engine so that an amount of fuel infected into the internal combustion engine becomes greater than that when the air-fuel ratio state determination section determines that the internal combustion engine is not in the air-fuel ratio imbalance state.

11. An air-fuel ratio imbalance state determination method of determining, in an internal combustion engine system including a multi-cylinder internal combustion engine, in which fuel injection is performed for each of cylinders, and an air-fuel ratio detection device that detects an air-fuel ratio and that is provided in an exhaust pipe, at which flows of exhaust gas from the cylinders of the internal combustion engine are combined, whether the internal combustion engine is in an air-fuel ratio imbalance state, in which there is an imbalance in air-fuel ratio between the cylinders of the internal combustion engine of the internal combustion engine system, the method comprising determining by an air-fuel ratio state determination section that the internal combustion engine is in the air-fuel ratio imbalance state when the internal combustion engine is in a predetermined steady operating state and an amount of change per unit time in the detected air-fuel ratio is not within a predetermined range; and, when it is determined that the internal combustion engine is in the air-fuel ratio imbalance state, controlling the internal combustion engine so that an amount of fuel injected into the internal combustion engine becomes greater than that when it is determined that the internal combustion engine is not in the air-fuel ratio imbalance state.

12. The air-fuel ratio imbalance state determination method according to claim 11, wherein the determining is performed using, as the amount of change per unit time in the detected air-fuel ratio, a value obtained by dividing the amount of change in the detected air-fuel ratio over a predetermined period of time where the predetermined period of time is a period of time from when the detected air-fuel ratio has reached an upper peak of a periodic variation of the detected air-fuel ratio to when the detected air-fuel ratio has reached a lower peak or a period of time from when the detected air-fuel ratio has reached the lower peak to when the detected air-fuel ratio has reached the upper peak adjacent to the lower peak, by the predetermined period of time.

13. The air-fuel ratio imbalance state determination method according to claim 11, further comprising:

calculating the amount of change per unit time in the detected air-fuel ratio a plurality of times; and, when an average value of the amounts of change obtained by calculating the amount of change the plurality of times is not within the predetermined range, determining that the internal combustion engine is in the air-fuel ratio imbalance state.

14. The air-fuel ratio imbalance state determination method according to claim 11, further comprising:

calculating the amount of change per unit time in the detected air-fuel ratio a plurality of times; and, when a maximum value of the amounts of change obtained by calculating the amount of change the plurality of times is not within the predetermined range, determining that the internal combustion engine is in the air-fuel ratio imbalance state.

15. The air-fuel ratio imbalance state determination method according to claim 11, further comprising:

calculating the amount of change per unit time in the detected air-fuel ratio a plurality of times;

calculating a sum of the amounts of change obtained by calculating the amount of change the plurality of times; and determining, based on the sum, whether the amount of change per unit time in the detected air-fuel ratio is within the predetermined range.

16. The air-fuel ratio imbalance state determination method according to claim 11, wherein also when the amount of change in the detected air-fuel ratio from when the detected air-fuel ratio has reached an upper peak of a periodic variation of the detected air-fuel ratio to when the detected air-fuel ratio has reached a lower peak or from when the detected air-fuel ratio has reached the lower peak to when the detected air-fuel ratio has reached the upper peak adjacent to the lower peak, is not within a second predetermined range, it is determined that the internal combustion engine is in the air-fuel ratio imbalance state.

17. The air-fuel ratio imbalance state determination method according to claim 11, wherein also when a difference between a maximum value and a minimum value of a rotation speed of the internal combustion engine during a plural number of cycles of the internal combustion engine is not within a third predetermined range, it is determined that the internal combustion engine is in the air-fuel ratio imbalance state.

18. The air-fuel ratio imbalance state determination method according to claim 11, wherein the controlling is performed so that the higher a degree of the imbalance is, the greater the amount of fuel injected into the internal combustion engine becomes.

* * * * *

UNITED STATES PATENT AND TRADEMARK OFFICE

CERTIFICATE OF CORRECTION

PATENT NO. : 8,939,135 B2
APPLICATION NO. : 12/985829
DATED : January 27, 2015
INVENTOR(S) : Kenya Maruyama, Takahiro Nishigaki and Toshitake Sasaki It is certified that error appears in the above-identified patent and that said Letters Patent is hereby corrected as shown below:

In the Specification
In Column 8, Line 36, after "ratio" delete "AR" and insert --AF--, therefor.
In the Claims
In Column 20, Line 41, in claim 10, after "fuel" delete "infected" and insert --injected--, therefor.

Signed and Sealed this
Sixteenth Day of February, 2016

Michelle K. Lee

Michelle K. Lee
*Director of the United States Patent and Trademark Office*